US006167847B1

(12) United States Patent
Ergezen et al.

(10) Patent No.: US 6,167,847 B1
(45) Date of Patent: Jan. 2, 2001

(54) CYLINDER LINER FOR A LIQUID-COOLED INTERNAL COMBUSTION ENGINE

(75) Inventors: Ugur Ergezen, Lieboch; Tuomas Tanska; Helmut Melde-Tuczai, both of Graz, all of (AT)

(73) Assignee: AVL List GmbH, Graz (AU)

( * ) Notice: Under 35 U.S.C. 154(b), the term of this patent shall be extended for 0 days.

(21) Appl. No.: 09/332,979

(22) Filed: Jun. 15, 1999

(30) Foreign Application Priority Data

Jun. 18, 1998 (AT) ..... 406/98 U

(51) Int. Cl.[7] ..... F02F 1/14
(52) U.S. Cl. ..... 123/41.79; 123/41.84
(58) Field of Search ..... 123/41.84, 41.83, 123/41.79

(56) References Cited

U.S. PATENT DOCUMENTS 4,093,842 6/1978 Scott .
4,370,952 2/1983 Mettig et al. .
5,746,161 * 5/1998 Boggs ..... 123/41.72

FOREIGN PATENT DOCUMENTS 480536 12/1969 (CH) .
1955140 4/1971 (DE) .
123218 5/1976 (DE) .
6346783 * 12 1994 (JP) .

* cited by examiner

*Primary Examiner*—Andrew M. Dolinar
*Assistant Examiner*—Katrina B. Harris
(74) *Attorney, Agent, or Firm*—Dykema Gossett PLLC

(57) ABSTRACT

A cylinder liner for a liquid-cooled internal combustion engine, includes a cylinder liner collar which is adjacent to a cylinder head sealing plane and into which is formed at least one circular cooling duct. In order to ensure adherence to a temperature window between a maximum temperature and a minimum temperature during operation, the cross section of the cooling duct is formed by a closed profile line within the cylinder liner collar, and the cross section of the cooling duct has a substantially oblong shape whose height as measured substantially in the direction of the cylinder liner axis is larger than its maximum width as measured substantially in the radial direction of the cylinder liner, with the arrangement and/or the cross-sectional shape of the cooling duct being provided in such a way that the cooling of the cylinder liner collar is higher in an upper zone which is closest to the cylinder head sealing plane than in a lower zone of the cooling duct which is disposed remotest from the cylinder head sealing plane.

18 Claims, 2 Drawing Sheets

CYLINDER LINER FOR A LIQUID-COOLED INTERNAL COMBUSTION ENGINE

BACKGROUND OF THE INVENTION

The invention relates to a cylinder liner for a liquid-cooled internal combustion engine, with a cylinder liner collar which is adjacent to a cylinder head sealing plane and in which at least one circular cooling duct is formed.

There are two boundary conditions for the cooling in the construction of cylinder liners. In order to prevent hot erosion, the surface temperature of the cylinder liner should not exceed approx. 190° C. in the entire working area of the piston rings. On the other hand, cold corrosion occurs by the sulphur in the fuel when the surface temperature of the cylinder liner drops below approx. 140° C. in the zone of the combustion chamber. Since the permitted temperature window is relatively small, the precise control and monitoring of the temperature of the cylinder liner is very important.

DESCRIPTION OF THE PRIOR ART

It is known to provide the collar of the cylinder liner with circular annular grooves which, in combination with the cylinder block, form cooling ducts extending in the circumferential direction. Moreover, it is known from U.S. Pat. No. 4,093,842 A to form cooling ducts into the collar of the cylinder liner, with the cooling ducts having an even width. The cross section of the cooling duct is formed by an open profile line. As a result of the even width of the cooling duct and the even wall thickness of the cylinder liner in the zone of the cooling duct, there will be an approximately linear drop of temperature, which leads to the consequence that the minimum temperature for preventing sulphur corrosion is not reached in a number of zones of the cylinder liner.

SUMMARY OF THE INVENTION

It is the object of the present invention to avoid such disadvantages and to improve the cooling of the cylinder liner in such a way that overheating and/or undercooling can be excluded.

This occurs in accordance with the invention in such a way that the cross section of the cooling duct is formed, within the cylinder liner collar, by a closed profile line having at least an inner, an outer and an upper section, and the cross section of the cooling duct is provided with a substantially oblong shape whose height as measured substantially in the direction of the cylinder liner axis is larger than its maximum width as measured substantially in the radial direction of the cylinder liner, with the arrangement and/or the cross-sectional shape of the cooling duct being provided in such a way that the cooling of the cylinder liner collar is higher in an upper zone which is closest to the cylinder head sealing plane than in a lower zone of the cooling duct which is disposed remotest from the cylinder head sealing plane. Preferably, the shape of the profile line and/or the wall thickness between cooling duct and inner jacket surface of the cylinder liner is a function of the combustion chamber temperature, the gas forces, the heat transmission coefficient between combustion gas and cylinder axis on the one hand and between cylinder liner and coolant on the other hand, the coolant temperature, the coolant pressure and/or the assembly force in the design point of the internal combustion engine. The shape of the cross section can thus be optimally adapted to the respective conditions and requirements.

It is preferably further provided that the width of the cooling water duct decreases, preferably continuously, from the upper zone with maximum width to the lower zone with minimum width. In this way it is possible to adequately cool the uppermost region of the cylinder liner in order to prevent any exceeding of the maximum permissible temperature. The cooling performance decreases with the distance from the cylinder head plane, so that thermally less stressed areas are cooled less.

A further embodiment of the invention provides that the liner wall thickness as measured between the inner section of the profile line and the inner jacket surface of the cylinder liner increases from a minimum liner wall thickness in the upper zone of the cooling duct to the lower zone. Accordingly, a better cooling is produced in high-temperature zones than in zones with lower liner temperature.

It can be provided within the scope of the invention that the cooling duct is provided with a substantially trapezoid, triangular or oval cross section.

Particularly when the cooling duct is designed with a strongly curved top surface area, high tensions in the liner wall can occur in the zone of the cooling chamber as a result of the assembly forces and the combustion forces. When tightening the cylinder head studs, axial pressure forces will occur which cause high tensile stress in the zone of the top surface area of the cooling duct. Additionally, compressive strain caused by radial combustion forces act at the same location on the cylinder liner in the zone of the top surface area of the cooling duct, thus giving rise to high peak tensile forces and respectively reducing the security factor. In order to achieve an overlapping of the peak tensile forces and a reduction of the tension amplitudes, it is advantageous if the profile line in the zone of the upper section forming the top surface area is curved less strongly than in the zone of the transition to the inner and/or outer section, with the upper section preferably being formed at least partly by a straight line which particularly preferably extends substantially parallel to the cylinder head sealing plane. In this way the peak tensile forces which are caused by the assembly forces and the combustion forces are mutually separated, with the maximum of the bending stress occurring in the middle zone of the top surface area and the maximum of the compressive strain caused by the combustion forces occurring at the edge zones of the top surface area or the transitional areas into the lateral profile lines.

In order to achieve an optimal progress of the cooling it is particularly advantageous if the inner profile line is inclined between 60° and 90°, preferably between 65° and 80°, and particularly preferably between 70° and 75°, to a normal plane on the cylinder liner axis. Best cooling results within the permitted temperature window are obtained when the inner section and the outer section of the profile line are inclined towards one another and preferably open up an angle of between 5° and 10°.

BRIEF DESCRIPTION OF THE DRAWINGS

The invention is now explained below in closer detail by reference to the enclosed drawings, wherein.

DETAILED DESCRIPTION OF THE PREFERRED EMBODIMENTS

Figure 1:
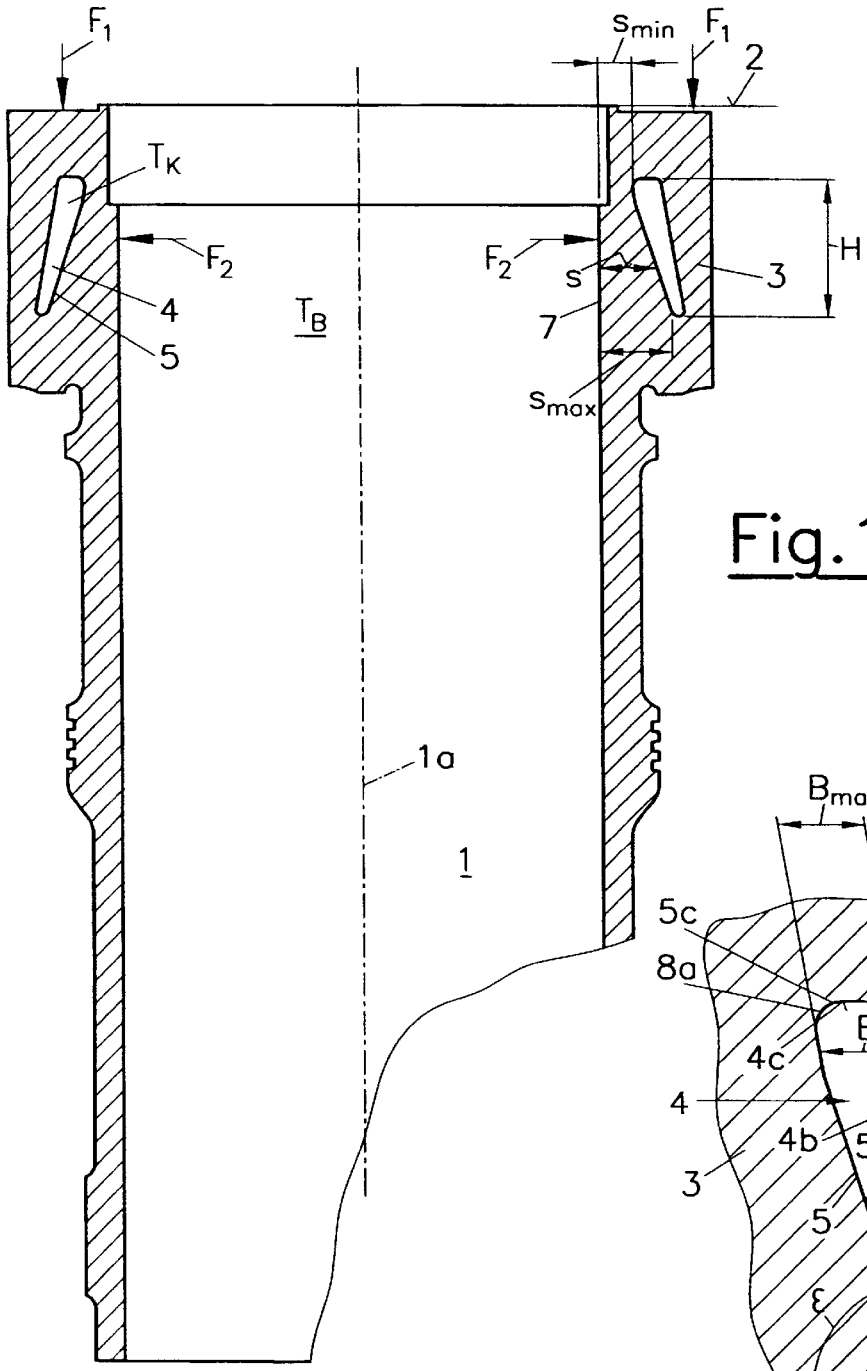
FIG. 1 shows a longitudinal sectional view through the cylinder liner in accordance with the invention.

The cylinder liner 1 is provided in its upper zone close to the cylinder head sealing plane 2 with a collar 3 into which a annular cooling duct 4 is cast. The inlet and outlet ports of the cooling duct 4, which can be disposed at the side or in the upper zone of the cylinder liner collar 3, are not shown in FIG. 1. The cross section of the cooling duct 4 is formed by a profile line 5 and is provided in the direction of the liner axis la with a substantially oblong shape. The inner section 5*a* and the outer section 5*b* of the profile line 5 are inclined towards one another and open up an angle β of of approx. 5°0 to 10° , so that the width B of the cooling duct 4 continuously decreases from a maximum value $B_{max}$ in an upper zone closest to the cylinder head plane 2 to a lower zone 9 with minimum width $B_{min}$. The width B is substantially smaller than the height H of the cooling duct 4. The inner profile line 5*a* is inclined towards a normal plane 6 on the liner axis 1*a* by an angle ϵ between 60° and 90°, preferably approx. between 65° and 80°, and particularly preferably between 70° and 75°. This leads to a minimum wall thickness $s_{min}$ of the cylinder liner 1 in the upper zone of the cooling duct 4 closest to the cylinder head sealing plane 2 between the inner side area 4*a* of the cooling duct 4 as defined between the inner section 5*a* of the profile line 5 and the inner jacket surface 7 of the cylinder liner 1, with the wall thickness s increasing from the zone of the top surface area 4*c* to the floor area 4*d* of the cooling duct 4 up to a maximum wall thickness $s_{max}$. The lower cooling cross section in the lower zone 9 and the relatively large distance from the inner jacket surface 7 cause a substantially lower cooling effect of the cylinder liner collar 3 of the cylinder liner 1 than in the zone of the top surface area 4*c* of the cooling duct 4.

The inner section 5*a* and the outer section 5*b* can be arranged in the embodiment approximately as a straight line or with a very small curvature. The lower section 5*d* of the profile line 5, which forms the floor area 4*d*, can be provided with a relatively small radius of curvature r.

On the one hand, assembly forces $F_1$ act in the axial direction on the cylinder liner 1 during the operation and, on the other hand, gas forces $F_2$ act in the radial direction during the combustion. As a consequence of the assembly forces $F_1$, tensile stress occurs in the zone of the top surface area 4*c* of the cooling duct 4 which is caused by the assembly forces $F_1$. Additionally, tension occurs in the zone of the top surface area 4*c* which is caused by the radial gas forces $F_2$. In the case of a strongly curved arrangement of the top surface area 4*c* there will be an overlapping of the peak tensions in the zone of the centre of the top surface area 4*c*. In order to avoid this, the upper section 5*c* of the profile line 5, which defines the top surface area 4*c*, is designed with the largest possible radius of curvature or, even better, as a straight line which is disposed approximately parallel to the cylinder head sealing plane 2. This causes an uncoupling of the peak tensions, so that the tensions by the combustion forces $F_2$ have their peak values in the zone of the transition 8*a* or 8*b* into the inner side area 4*a* or outer side area 4*b* of the cooling duct 4, whereas the peak tensions by the assembly forces $F_1$ remain in the middle zone 8*c* of the top surface area 4*c*, which causes a reduction of the tension amplitude.

Figure 2:
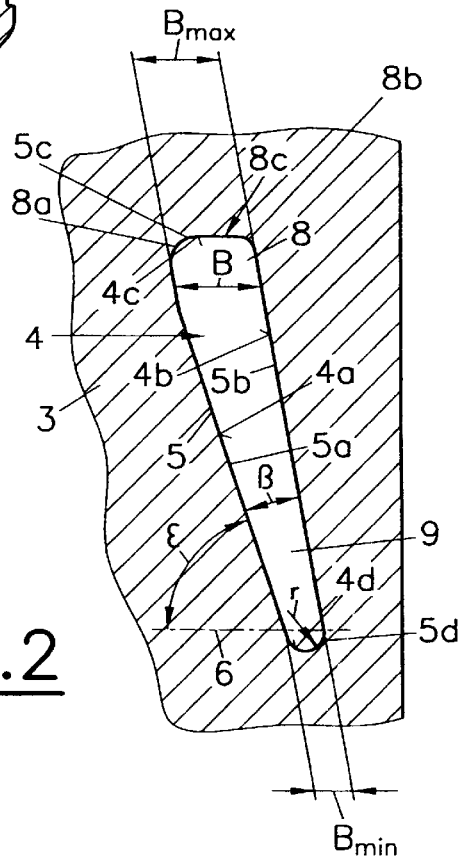
FIG. 2 shows an enlarged sectional view through the cooling duct of FIG. 1, the cooling duct having a substantially oblong cross sectional shape.
Figure 2A:
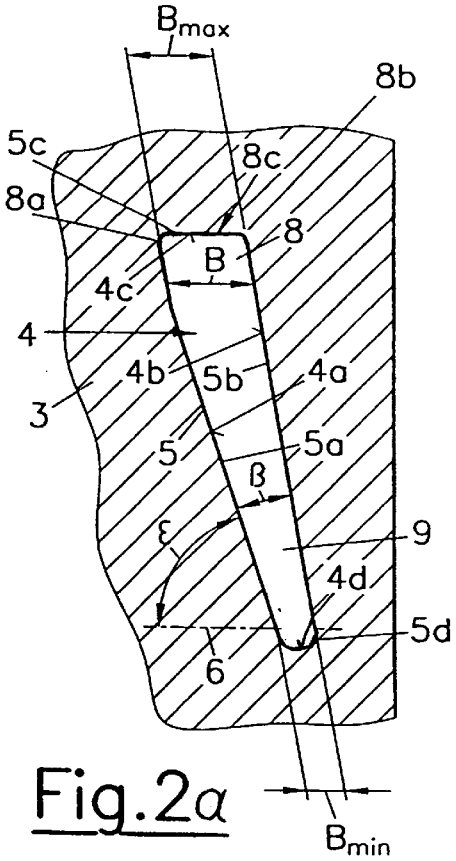
FIGS. 2*a*–2*c* show other embodiments of cooling ducts which have substantially trapezoid, triangular and oval cross sections, repectively.
Figure 2B:
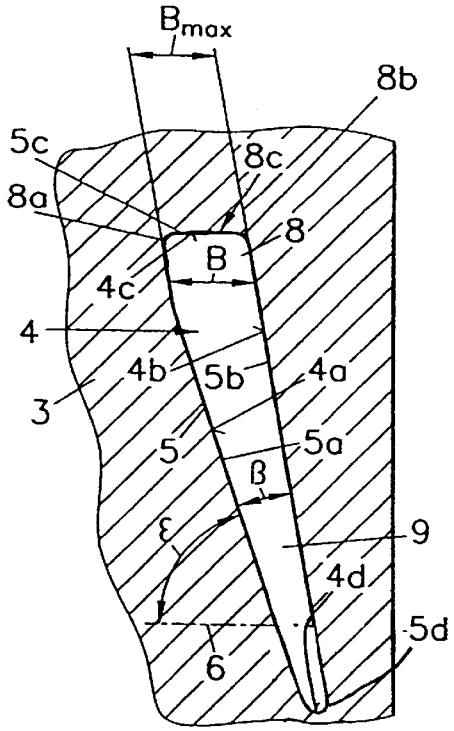
Figure 2C:
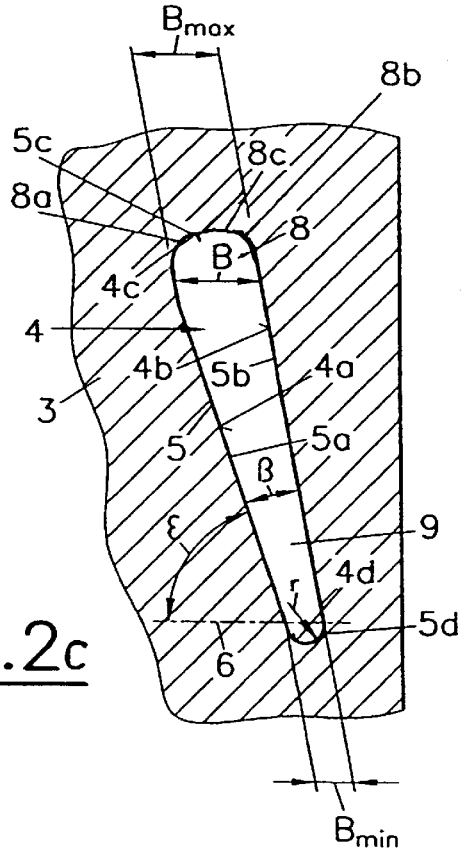

As shown it FIGS. 2*a*–2*c*, the cross section of the cooling duct 4 can be trapezoid or triangular, or even have the shape of an oval or ellipse. By considering the requirement that a temperature window of between 140° and 190° of the cylinder liner is observed, the shape of the profile line can be represented and optimized as a function of the combustion chamber temperature $T_B$, the thermal diffusivity $a_g$ or $a_k$ of the combustion gases or the cooling liquid, the cooling liquid temperatures $T_K$ and the occurring peak tensions as a result of the assembly forces $F_1$ and the gas forces $F_2$.

We claim:

1. A cylinder liner for a liquid-cooled internal combustion engine, with a cylinder liner collar which is adjacent to a cylinder head sealing plane and into which is formed at least one annular cooling duct, wherein a cross section of the cooling duct is formed, within the cylinder liner collar, by a closed profile line having at least an inner, an outer and an upper section, and the cross section of the cooling duct is provided with a substantially oblong shape whose height as measured substantially in the direction of the cylinder liner axis is larger than its maximum width as measured substantially in a radial direction of the cylinder liner, with an arrangement and a cross-sectional shape of the cooling duct being provided in such a way that the cooling of the cylinder liner collar is higher in an upper zone which is closest to the cylinder head sealing plane than in a lower zone of the cooling duct which is disposed remotest from the cylinder head sealing plane, and wherein the liner wall thickness as measured between the inner section of the profile line and an inner jacket surface of the cylinder liner increases from a minimum liner wall thickness in the upper zone of the cooling duct towards the lower zone.

2. A cylinder liner according to claim 1, wherein the width of the cooling water duct decreases, from the upper zone with maximum width to the lower zone with minimum width.

3. A cylinder liner according to claim 2, wherein the width of the cooling water duct decreases continously, from the upper zone with maximum width to the lower zone with minimum width.

4. A cylinder liner according to claim 1, wherein the cooling duct is provided with a substantially trapezoid cross section.

5. A cylinder liner according to claim 1, wherein the cooling duct is provided with a substantially triangular cross section.

6. A cylinder liner according to claim 1, wherein the cooling duct is provided with a substantially oval cross section.

7. A cylinder liner according to claim 1, wherein the inner section of the profile line is formed at least in sections by a straight line.

8. A cylinder liner according to claim 1, wherein the outer section of the profile line is formed at least in sections by a straight line.

9. A cylinder liner according to claim 1, wherein the profile line is curved less strongly in the zone of the upper section forming the top surface area than in a zone of the transition to the inner section.

10. A cylinder liner according to claim 1, wherein the profile line is curved less strongly in the zone of the upper section forming the top surface area than in a zone of the transition to the outer section.

11. A cylinder liner according to claim 1, wherein the upper section is formed at least partly by a straight line.

12. A cylinder liner according to claim 11, wherein the straight line extends substantially approximately parallel to the cylinder head sealing plane.

13. A cylinder liner according to claim 1, wherein the inner section of the profile line is inclined between 60° and 90° to a normal plane on the cylinder liner axis.

14. A cylinder liner according to claim 13, wherein the inner section of the profile line is inclined between 65° and 80° to a normal plane on the cylinder liner axis.

15. A cylinder liner according to claim 13, wherein the inner section of the profile line is inclined between 70° and 75° to a normal plane on the cylinder liner axis.

16. A cylinder liner according to claim 1, wherein the shape of the profile line and the wall thickness between the cooling duct and the inner jacket surface of the cylinder liner is a function of at least one parameter of the group combustion chamber temperature, gas forces, heat transmission coefficient between combustion gas and cylinder axis on the one hand and between cylinder liner and coolant on the other hand, coolant temperature, coolant pressure and assembly force in the design point of the internal combustion engine.

17. A cylinder liner according to claim 1, wherein the inner section and the outer section of the profile line are inclined towards one another.

18. A cylinder liner according to claim 17, wherein the inner section and the outer section of the profile line open up an angle of between 5° and 10°.

* * * * *